US009889362B2

(12) United States Patent
Hoggatt

(10) Patent No.: US 9,889,362 B2
(45) Date of Patent: Feb. 13, 2018

(54) STRAND-FILLED PUNCHING BAGS

(71) Applicant: Doug Hoggatt, Portland, OR (US)

(72) Inventor: Doug Hoggatt, Portland, OR (US)

( * ) Notice: Subject to any disclaimer, the term of this patent is extended or adjusted under 35 U.S.C. 154(b) by 0 days.

(21) Appl. No.: 14/804,207

(22) Filed: Jul. 20, 2015

(65) Prior Publication Data

US 2017/0021258 A1 Jan. 26, 2017

(51) Int. Cl.
*A63B 69/20* (2006.01)
*A63B 71/00* (2006.01)

(52) U.S. Cl.
CPC ..... *A63B 69/201* (2013.01); *A63B 71/0054* (2013.01); *A63B 2209/10* (2013.01)

(58) Field of Classification Search
CPC ..... A63B 69/201; A63B 69/20; A63B 69/004
See application file for complete search history.

(56) References Cited

U.S. PATENT DOCUMENTS 4,721,302 A * 1/1988 Murphy ..... A63B 69/201 473/442
5,263,912 A * 11/1993 Stelmach ..... A63B 69/004 473/442
6,726,605 B2 * 4/2004 Chen ..... A63B 21/0602 482/83
6,743,157 B2 * 6/2004 Hackaday ..... A63B 69/206 482/83
6,994,658 B2 * 2/2006 Laudenslager ..... A63B 69/201 482/83
8,652,014 B2 * 2/2014 Smith ..... A63B 69/201 482/83

* cited by examiner

*Primary Examiner* — Loan H Thanh
*Assistant Examiner* — Megan Anderson
(74) *Attorney, Agent, or Firm* — Mohr Intellectual Property Law Solutions, PC

(57) ABSTRACT

Strand-filled punching bags including punching bags filled with a plurality of strands made from a variety of possible materials are disclosed. In some examples, the strand-filled punching bag includes a sheath that extends to and contacts a surface located below the punching bag, such as a floor, and is equipped with an additional abrasion sheath to help control the swing characteristics of the punching bag. In some further examples, the strand-filled punching bag includes a shorter sheath that does not contact the surface below the punching bag, and thus lacks an additional abrasion sheath.

18 Claims, 6 Drawing Sheets

STRAND-FILLED PUNCHING BAGS

BACKGROUND

The present disclosure relates generally to striking and punching bags used for athletic training. In particular, punching bags that are filled with a number of strands such as chains, and optionally have a length that contacts the ground, are described.

Known punching and striking bags are not entirely satisfactory for the range of applications in which they are employed. For example, most existing punching bags are heavy, dense and offer too much resistance when struck. The typical punching bag is filled with a material such as sand, which in addition to adding mass, presents only limited movement in response to strikes, and rather predominately absorbs the energy from strikes while translating the absorbed energy into minimal movement. The dense material also allows for a comparatively higher proportion of the strike energy to be absorbed by the athlete's fist. As a result, repeatedly striking a punching bag or other similar equipment over long a period of time that presents too much resistance exposes the joints, bones, tendons, ligaments, organs, circulatory system and heart to unnecessary shock. This ultimately can be unhealthy, as it can lead to chronic injuries, especially with older-aged athletes.

Alternatively or additionally, training with most traditional equipment (e.g. overly heavy bags, wooden dummies, floor-mounted training equipment) that offers too much resistance can result in the athlete unconsciously learning to "pull his punches", so to speak, as the athlete learns when to stop to prevent increasing injuries while hitting. Consequently, the athlete fails to develop the full potential power of his or her punch. Equipment that offers too much resistance can also lead to an athlete telegraphing his or her moves, as the athlete physically braces for the inevitable impact, which also can result in improper balance and stance.

Conversely, striking with little to no resistance (e.g, striking into air only) can result in the developing of chronic injuries due to hyperextension of joints, and ligaments due to zero resistance at the end of a strike. This is a common result for inexperienced athletes or those who have not had appropriate training.

If the athlete does not wear protective gear, as may be the case in certain fighting disciplines, the skin on the athlete's body where it comes into contact with a relatively high-resistance punching bag can be more prone to injury. Furthermore, wearing protective gear during workouts can be uncomfortable, while replacing protective gear due to premature wear from repeated contact with a high-resistance punching bag presents an added expense to training.

Thus, there exists a need for punching bags that improve upon and advance the design of known punching striking and punching bags. Examples of new and useful punching bags relevant to the needs existing in the field are discussed below.

SUMMARY

The present disclosure is directed to a strand-filled punching bag that is filled with a plurality of strands made from a variety of possible materials. In some examples, the strand-filled punching bag includes a sheath that extends to and contacts a surface located below the punching bag, such as a floor, and is equipped with an additional abrasion sheath to help control the swing characteristics of the punching bag.

In some further examples, the strand-filled punching bag includes a shorter sheath that does not contact the surface below the punching bag, and thus lacks an additional abrasion sheath.

DETAILED DESCRIPTION

Figure 1:
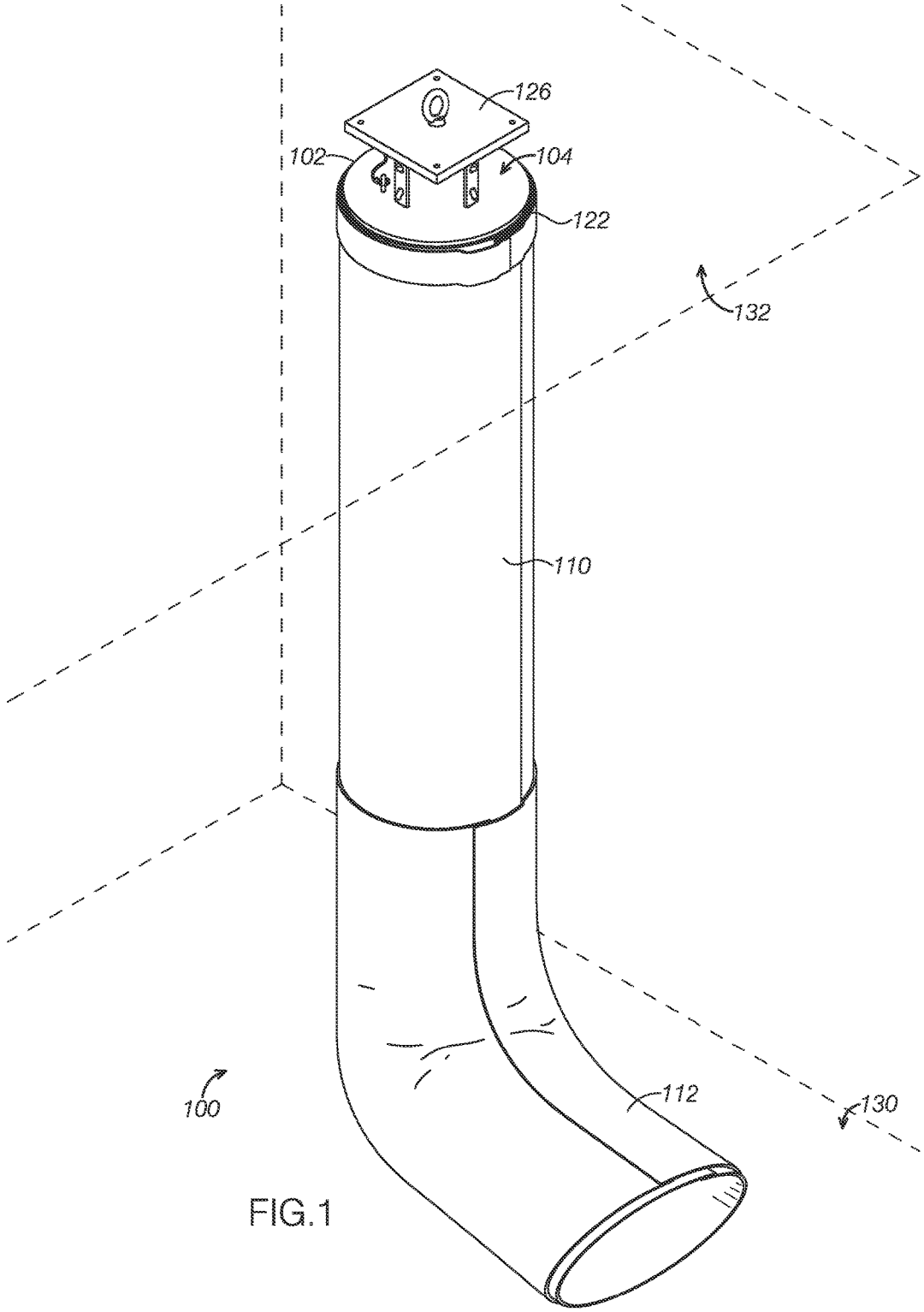
FIG. 1 is a perspective view of a first example of a strand-filled punching bag.

The disclosed punching bags will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various punching bags are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-5, a first example of a strand-filled punching bag, punching bag 100, will now be described. Punching bag 100 functions to provide a punching bag with a completely flexible interior, an ideal resistance and response to strikes, and a strike response that more accurately resembles that of a human opponent. This reduced mass and more natural movement substantially reduces the chances of injuries, including both impact and hyperextension. The ideal mass and response encourages an athlete to develop the full potential and power of his or her strikes and punches, and also to adopt a more natural stance with proper bone alignment to ultimately make for more effective combat technique. The reader will appreciate from the figures and description below that punching bag 100 addresses shortcomings of conventional punching bags.

For example, by utilizing a filling comprised of a plurality of strands, such as cords or chains, punching bag 100 offers less resistance than traditional sand-filled punching bags.

Depending on the type of cords used for filling, punching bag 100 can provide a mass comparable to traditional punching bags, but with a better response and greater give when struck. Further, a lighter mass bag can be implemented in a portable configuration, by use of a single mounting point that can be connected to a stand or a ceiling mount by a simple hook or latch. Because punching bag 100 uses a plurality of strands that possess a comparatively large amount of space between them and, in a preferred embodiment, a center void, punching bag 100 is substantially more collapsible compared to traditional punching bags, allowing it to be placed into a backpack or duffel bag, and easily transported.

Punching bag 100 is comprised of a plate 102 having a top surface 104 and a bottom surface 106, a plurality of strands 108 connected to plate 102 so as to extend from bottom surface 106 of plate 102, and a sheath 110 attached to the perimeter of plate 102 and covering at least a portion of each of plurality of strands 108. A mounting plate 126 can be flexibly attached to a top surface 104 of plate 102 with one or more flexible connectors 128, to facilitate suspending punching bag 100 from a surface 132 located above punching bag 100 (e.g. the ceiling). In one example, punching bag 100 also includes an abrasion sheath 112 that covers at least a portion of sheath 110, which, together with abrasion sheath 112, makes contact with a surface 130 located below punching bag 100 (e.g. the ground or floor). In other examples as will be discussed further herein, punching bag 100 includes a shorter sheath 110 that lacks abrasion sheath 112, but can be suspended without making contact with surface 130 located below punching bag 100.

Figure 2:
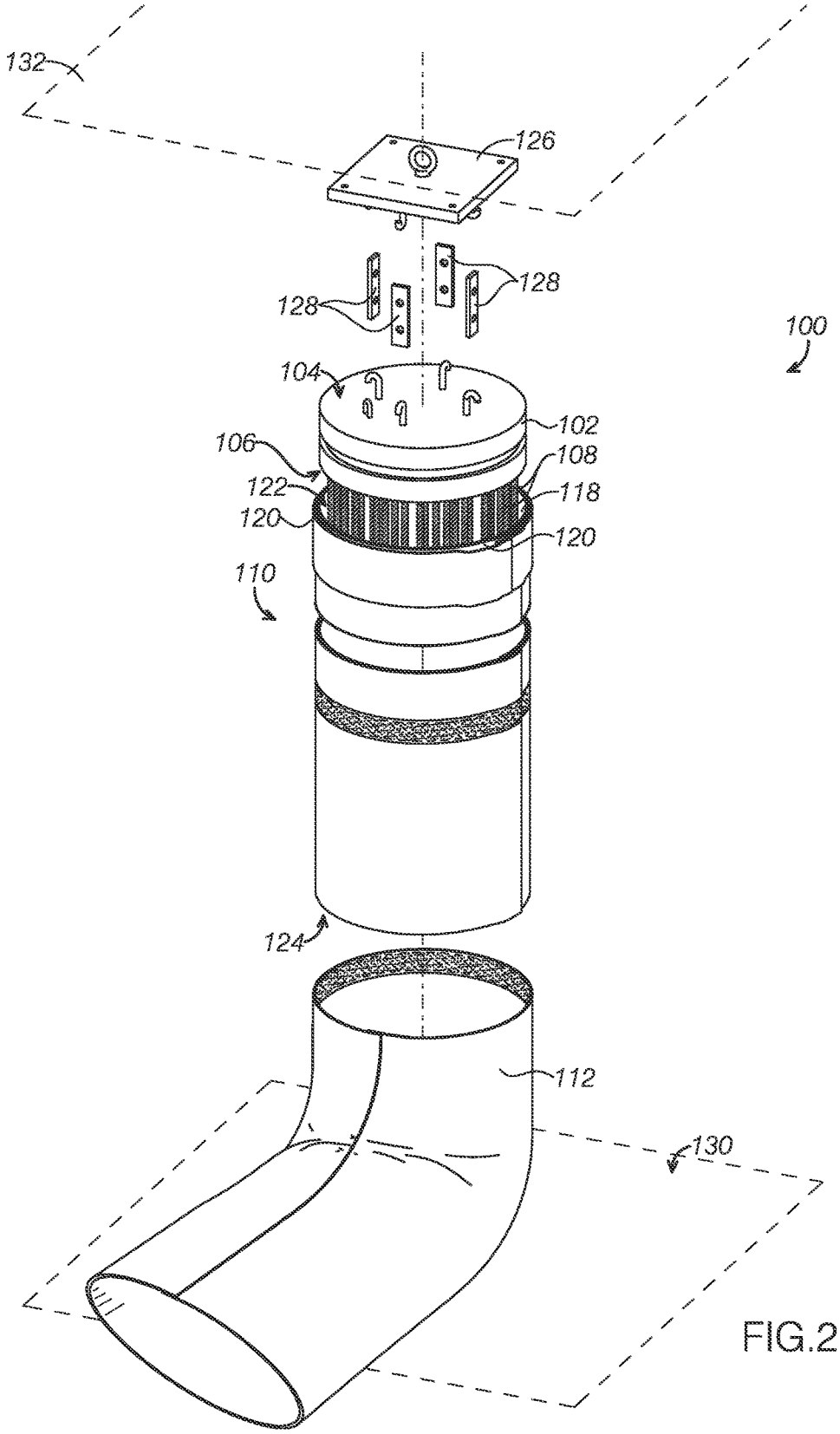
FIG. 2 is a cutaway perspective view of the strand-filled punching bag shown in FIG. 1 depicting the internal components.
Figure 3:
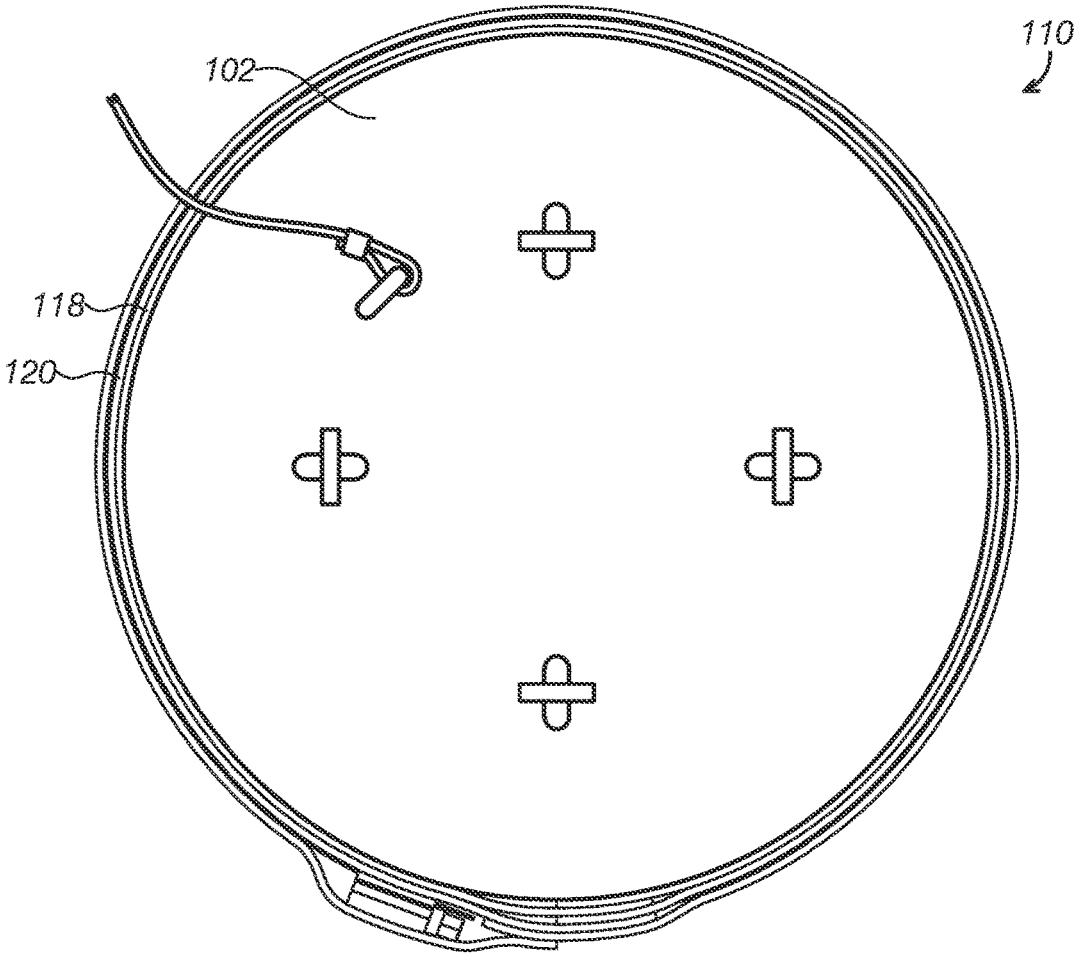
FIG. 3 is a top view of the strand-filled punching bag shown in FIG. 1 depicting the plate and sheath layers.
Figure 5:
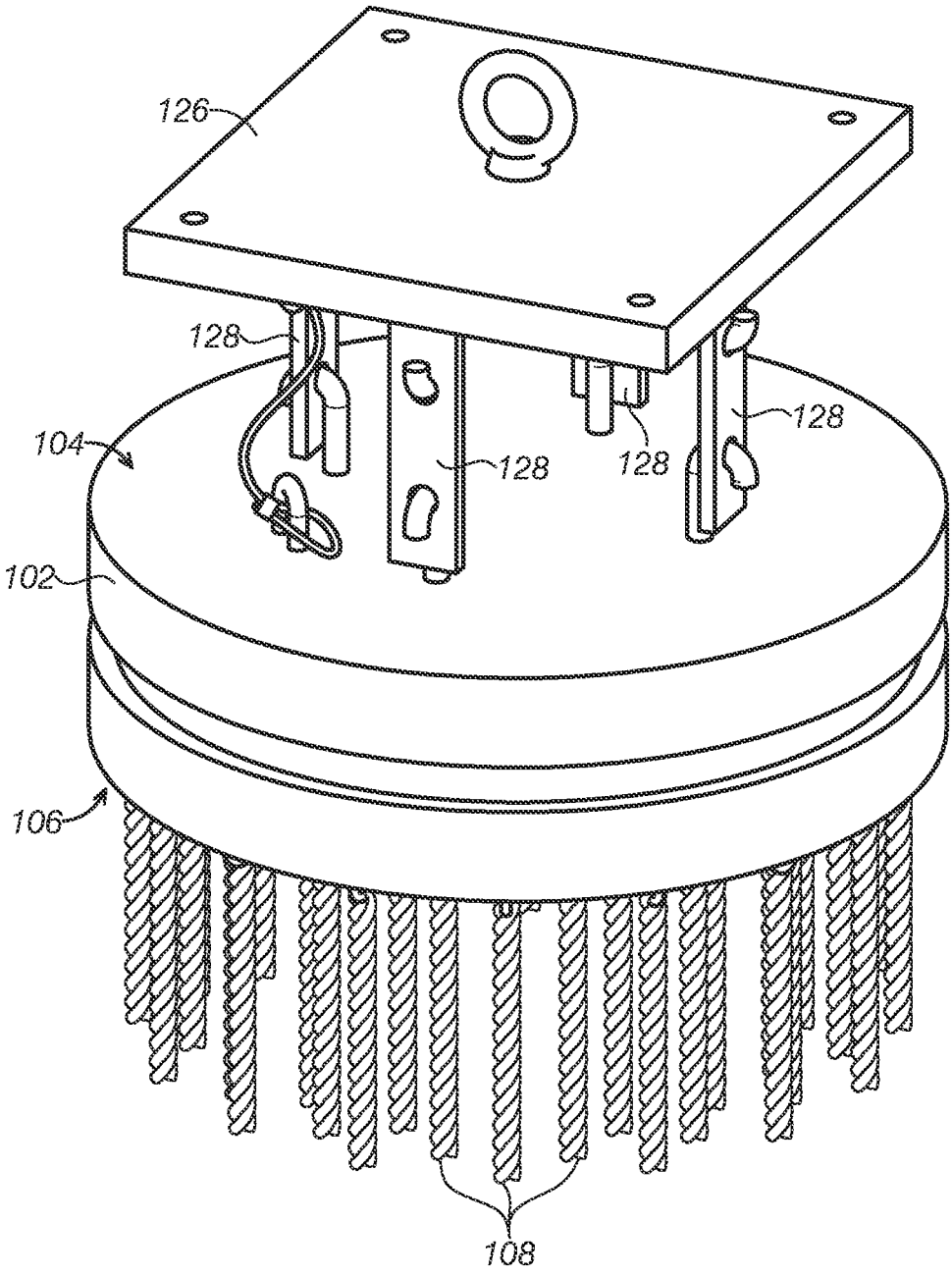
FIG. 5 is a close-up perspective view of the top assemblies of the strand-filled punching bag shown in FIG. 1 depicting the mounting plate and connecting components.

As can be seen in FIGS. 1, 2 and 5, plate 102 provides the foundation from which punching bag 100 is assembled. Plate 102 is preferably a round disc of sturdy material such as wood, plywood, engineered wood such as oriented strand board or fiberboard, plastic, ceramic, concrete, metal, composites such as fiberglass or carbon fiber-epoxy, or any other suitable material capable of supporting the weight of punching bag 100 components attached thereto, as well as its weight when suspended in position for use. Plate 102 can also be implemented in a shape other than round, e.g. square or polygonal, and can be made in a variety of diameters depending on the size of punching bag 100 that is desired.

Plate 102 has an outer perimeter around which is attached one end of sheath 110. Thus, at least the perimeter of plate 102 must be tall enough to provide enough surface area to secure the first end 122 of sheath 110. As depicted in FIG. 5, the perimeter of plate 102 can be fitted with a groove or channel into which the means by which sheath 110 is fastened, which will be discussed in greater detail below, can press the first end 122 of sheath 110, thereby providing a secure attachment. The overall thickness of plate 102 can, but need not, be the same as the perimeter of plate 102. Depending on the materials used to implement plate 102 and the needs of the specific implementation of punching bag 100, the perimeter may be designed as a flange that protrudes above top surface 104, bottom surface 106, or both.

In the example shown in FIG. 2, a plurality of strands 108 are attached to plate 102, and protrude from bottom surface 106 of plate 102. Each of the plurality of strands 108 are constructed from a material such as chain, rope, cable, cord, a series of hollow tubes strung sequentially upon a cord, or any other suitably durable flexible strand-like material. The selection of material can be made with respect to the feel of the bag. Where plurality of strands 108 are constructed from a dense material such as metal, the bag will have a heavier feel than then when plurality of strands 108 are constructed from rope or a series of hollow tubes made from plastic. Furthermore, the construction of each of plurality of strands 108 can be homogenous, e.g. all strands 108 are constructed from identical material, or mixed, e.g. each of plurality of strands 108 can be constructed from varying materials.

Figure 4A:
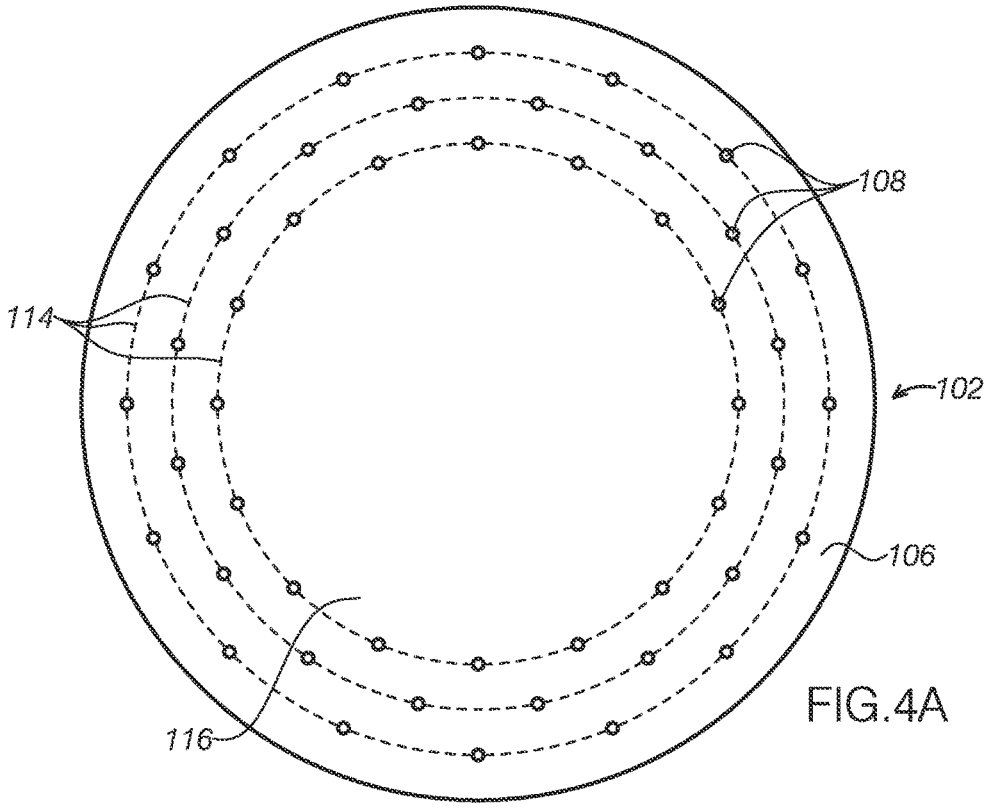
FIGS. 4A-4B are bottom views of the plate of the strand-filled punching bag shown in FIG. 1 depicting possible arrangements of the strands.

As can be seen in FIG. 4A, plurality of strands 108 are attached to plate 102 preferably in a concentric circular pattern, with plurality of circle arrangements 114 and a void 116 located in the center. Each of the circle arrangements 114 in the concentric circular pattern could have a plurality of strands 108 constructed from one type of material, but from a different material than the other circle arrangements 114. For example, by using a lighter material for the plurality of strands 108 located most proximal to sheath 110 and utilizing progressively heavier material for strands 108 located progressively closer to void 116, a punching bag 100 can be devised that offers a degree of progressively increasing resistance to strikes. Such flexible arrangements allows a user or manufacturer of punching bag 100 to tailor a feel that most closely approximates that of a human opponent, or achieves any other desired training goals. In other possible arrangements, void 116 can be omitted entirely, and the concentric circle arrangements 114 can be extended to fill to the center of plate 102.

Figure 4B:
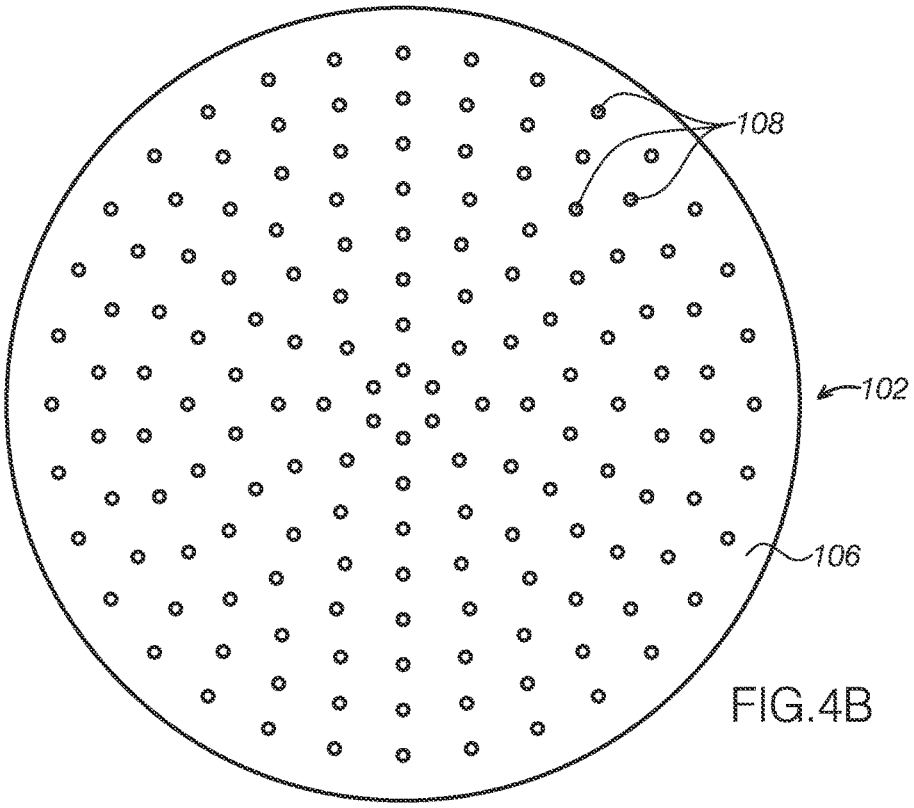

FIG. 4B depicts another possible arrangement of plurality of strands 108, which are positioned from plate 102 in a random fashion, with no central void. As above, plurality of strands 108 can be made from a homogenous material, a random selection of materials, or materials that vary in weight and consistency depending upon location on plate 102. It will be appreciated by a person skilled in the relevant art that FIGS. 4A and 4B depict only two possible arrangements of plurality of strands 108, and an infinite variety of arrangements are possible without departing from the disclosed invention. Plurality of strands 108 can be attached to plate 102 by any means allowing for secure, preferably removable, attachment, e.g. bolts, adhesives, fasteners, screws, hooks, staples, welds, eyebolts, or any other fastening means now known or later devised.

Surrounding plurality of strands 108 and, as described above, having a first end 122 that is attached to plate 102, is sheath 110. The construction of sheath 110 is depicted more fully in FIG. 3, which shows sheath 110 as preferably being constructed of a flexible inner sheath 118 and a flexible outer sheath 120. Flexible inner sheath 118 is constructed from rubber sheet, foam, foam rubber, leather, fabric or any other suitable material that is durable and optionally provides a measure of padding, depending on the desired characteristics of punching bag 100. Flexible outer sheath 120 is constructed of leather, vinyl, nylon, PVC, rubber sheet, fabric, or any other material that is durable enough to withstand the force and friction of repeated strikes from the user of punching bag 100. Flexible inner sheath 118 may optionally be attached to flexible outer sheath 120 to form a single sheath 110, or may be kept separate where having a flexible outer sheath 120 that can be independently replaced is desired. Alternatively, sheath 110 can be constructed of a single layer that is made of a material that is suitably resistant to repeated strikes, and optionally provides a measure of padding similar to that offered by flexible inner sheath 118.

Sheath 110 has a first end 122 that is preferably removably attached to plate 102. Sheath 110 can be attached using any means now known or later devised that allows for secure attachment to plate 102, including a rubber or elastic band or strap, a suitably sized hose clamp, a latching ring, or any other suitable similar device. The means of attachment can optionally be covered by a sheath or other covering if desired for aesthetic appearance and/or to protect the athlete's hands from inadvertent striking of the attachment means, which may have protrusions that could cause injury.

FIG. 5 depicts a close-up of plate 102 and mounting plate 126. Mounting plate 126 is typically attached to a surface 132 located immediately above the punching bag, and in turn plate 102 is attached to mounting plate 126 by one or more flexible connectors 128. Additionally, a safety cable or chain (shown in the figures but not numbered) may be affixed between mounting plate 126 and plate 102 to add a measure of security in the event one or more of flexible connectors 128 break lose. A safety cable or chain will serve as a backup and keep punching bag 100 from falling to the floor, potentially causing injury or damage.

Mounting plate 126 is constructed from similar materials as plate 102, e.g. metal, wood, plywood, strand board, ceramic, composite, stone, fiberglass, or another suitably rigid material that can support the weight of punching bag 100 suspended from above, along with the transient forces experienced when punching bag 100 is being used. An eyebolt can be secured into the top of mounting plate 126 to facilitate hanging punching bag 100 from a surface 132 immediately above it. Mounting plate 126 can be made in any suitable shape, e.g. square, round, polygonal.

Extending from the surface of mounting plate 126 opposite the eyebolt are one or more flexible connectors 128, which secure plate 102, and by extension the remainder of punching bag 100, from mounting plate 126. Flexible connectors 128 assist in reducing the possible transmission of noise and vibrations generated from use of punching bag 100 through to the surface 132 (e.g. ceiling or mounting stand), and provide additional flexibility and movement to punching bag 100 when struck. Flexible connectors 128 can be manufactured from rubber, plastic, synthetic plastics, silicone, metal springs, or any other suitably flexible and vibration damping material now known or later developed. The length of flexible connectors 128 can be varied to achieve different movement and feels of punching bag 100, and/or to assist in adjusting the overall height of punching bag 100. Flexible connectors 128 can also be made removable in order to facilitate replacement as the connectors wear out, or if reconfiguring punching bag 100 is desired.

In one possible embodiment, sheath 110 has a second end 124 and is of sufficient length that second end 124 is located past the ends of plurality of strands 108, and makes contact with surface 130 located immediately below punching bag 100. This contact between second end 124 and surface 130 assists in damping any swinging motion imparted to punching bag 100 by the user's strikes, resulting in punching bag 100 ceasing swinging substantially sooner than a bag that is suspended entirely above the ground, which is a closer approximation to a human target. Ideally, plurality of strands 108 extend to within an inch of second end 124, and are of sufficient length along with sheath 110 so as to partially contact surface 130. By ensuring that at least a portion of plurality of strands 108 rests against surface 130 (albeit while enveloped within sheath 110), any swinging of punching bag 100 can be brought under arrest faster. To protect sheath 110 from undue wear, an abrasion sheath 112 is removably affixed to at least a portion of sheath 110, and covers second end 124. Abrasion sheath 112 is constructed of rubber, fabric, leather, vinyl, plastic, or any other suitably abrasion-resistant material now known or later developed. Abrasion sheath 112 can be removably affixed to sheath 110 by use of Velcro, ties, elastic bands, or any other suitable means to keep abrasion sheath 112 affixed to sheath 110 in a single spot while still facilitating subsequent removal and replacement.

Figure 6:
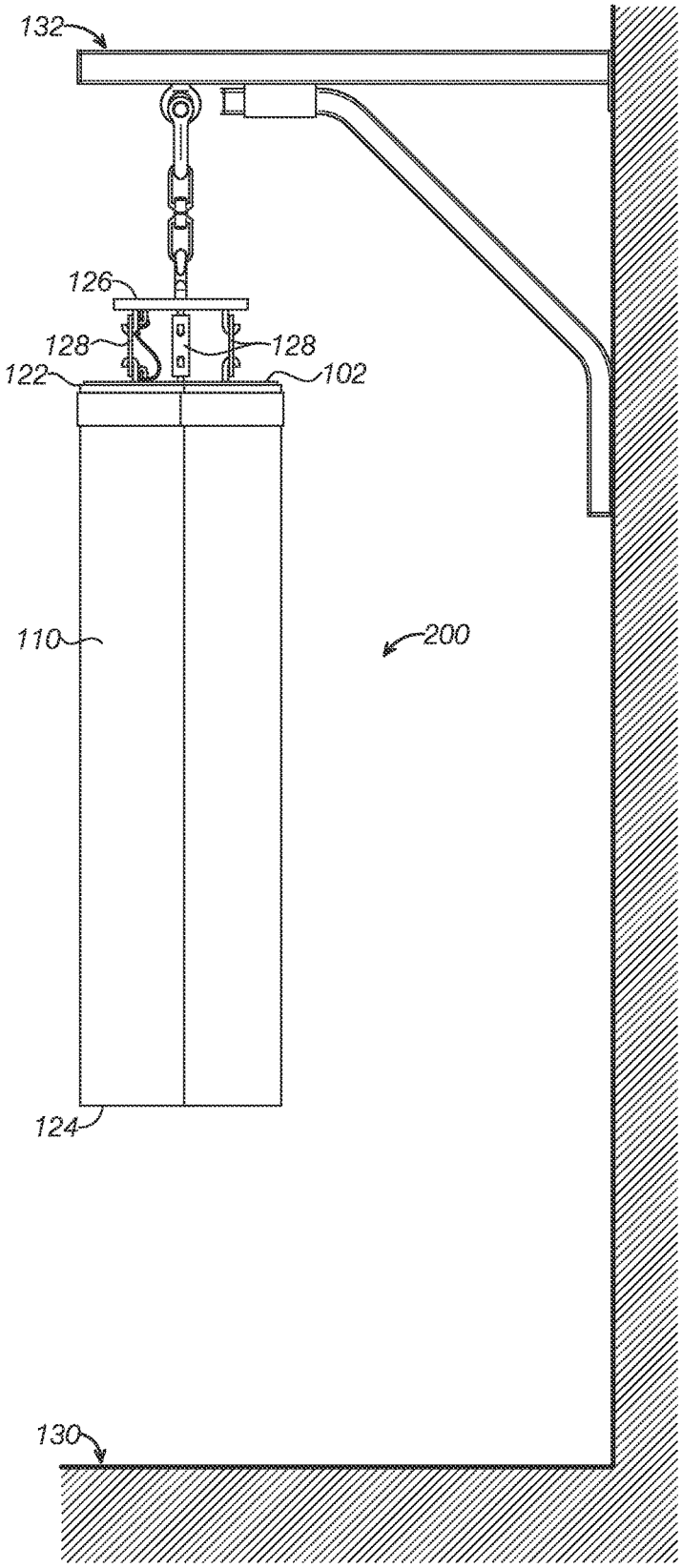
FIG. 6 is a perspective view of a second example of a strand-filled punching bag showing a shortened overall length.

Turning attention to FIG. 6, a second example of a strand-filled punching bag, punching bag 200, will now be described. Punching bag 200 includes many similar or identical features to punching bag 100. Thus, for the sake of brevity, each feature of punching bag 200 will not be redundantly explained. Rather, key distinctions between punching bag 200 and punching bag 100 will be described in detail and the reader should reference the discussion above for features substantially similar between the two strand-filled punching bags.

As can be seen in FIG. 6, punching bag 200 includes plate 102, sheath 110, mounting plate 126 attached to plate 102 via flexible connectors 128, and is suspended between surface 130 below punching bag 200 and surface 132 above punching bag 200.

The particular difference is in the overall length of punching bag 200. Unlike punching bag 100, sheath 110 of punching bag 200 has a second end 124 that is suspended above surface 130 below punching bag 200. This makes punching bag 200 substantially shorter than punching bag 100, which intentionally contacts surface 130 to aid in controlling its response to strikes. In contrast, punching bag 200 provides a lighter and less controlled response, and exhibits more of the sustained swinging action of traditional bags, which may be preferred by some athletes. Because punching bag 200 is shorter, the need for an abrasion sheath 112 is obviated. Second end 124 is sealed off to form sheath 110 into a pouch configuration. Plurality of strands 108 are preferably attached on their ends opposite plate 102 to second end 124.

It will be appreciated by a person skilled in the relevant art that punching bags 100 and 200 are only two examples of possible lengths, and that a punching bag can be made of any suitable length and/or diameter to meet desired training goals and punching bag characteristics without departing from the disclosed invention.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A punching bag, comprising:

a plate having a top surface and a bottom surface;

a plurality of strands connected to the plate so as to extend from the bottom surface of the plate; and a sheath attached to a perimeter of the plate and covering at least a portion of each of the plurality of strands;

wherein each strand in the plurality of strands are solid and the number and composition of the plurality of strands are selected to provide a desired strike response when the punching bag is struck.

2. The punching bag of claim 1, wherein the plurality of strands are arranged in a concentric circular pattern.

3. The punching bag of claim 2, wherein the plurality of strands are arranged so that there is a void within the center of the concentric circular pattern.

4. The punching bag of claim 1, further comprising a mounting plate flexibly attached to the top surface of the plate.

5. The punching bag of claim 4, wherein the mounting plate is flexibly attached to the top surface of the plate with one or more flexible connectors.

6. The punching bag of claim 1, further comprising an abrasion sheath disposed concentrically around at least a portion of the sheath attached to the perimeter of the plate.

7. The punching bag of claim 1, wherein the sheath is comprised of an inner layer and an outer layer disposed concentrically around the inner layer.

8. The punching bag of claim 1, wherein the plurality of strands are comprised of chain, cable, rope, cord, or any combination thereof.

9. A punching bag, comprising:

a mounting plate;

a plate with a top surface and a bottom surface that is movably affixed to the mounting plate;

a plurality of strands having first ends each attached to the bottom surface of the plate and second ends;

a flexible inner sheath that is substantially tubular and possesses a first end disposed around a perimeter of the plate so as to contain the plurality of strands, and a second end located past the second ends of the plurality of strands;

a flexible outer sheath that is of similar length to the inner sheath and disposed concentrically around the inner sheath; and the mounting plate being suspended substantially parallel to the plate via flexible connectors.

10. The punching bag of claim 9, wherein the plurality of strands are secured to the second end of the inner sheath.

11. The punching bag of claim 10, wherein the punching bag is suspended from a surface immediately above the punching bag, and the inner sheath and outer sheath are of a length so as to not contact a surface positioned immediately below the punching bag.

12. The punching bag of claim 11, wherein the second end of the inner sheath is sealed shut.

13. The punching bag of claim 9, wherein the outer sheath is of sufficient length to at least contact a surface immediately below the punching bag when the punching bag is suspended from a surface immediately above the punching bag.

14. The punching bag of claim 13, further comprising an abrasion sheath that is disposed concentrically around at least a portion of the inner sheath and outer sheath, and has a length that extends past the end of the inner sheath and outer sheath so that at least a portion of the abrasion sheath contacts the surface immediately below the punching bag.

15. The punching bag of claim 9, wherein the inner sheath is comprised of fabric, foam, foam rubber, or rubber sheeting.

16. A punching bag, comprising:

a plate with a top surface and a bottom surface, the top surface attached to a surface above the punching bag;

a plurality of strands having first ends and second ends, the first ends being attached to the plate and extending from the bottom surface;

a sheath disposed around a perimeter of the plate; and an abrasion sheath covering at least a portion of the sheath;

wherein the abrasion sheath makes contact with a surface located below the punching bag, the abrasion sheath being deformable and encircling the sheath for attachment thereto, the abrasion sheath maintaining only a contact friction relationship with the surface located below the punching bag.

17. The punching bag of claim 16, further comprising a mounting plate, and wherein the top surface of the plate is attached to the surface above the punching bag by attaching the mounting plate to the surface above the punching bag, and movably attaching the top surface of the plate to the mounting plate.

18. The punching bag of claim 17, wherein the mounting plate has a top surface and a bottom surface, where the top surface of the mounting plate is attached to the surface above the punching bag, and the bottom surface is movably attached to the top surface of the plate with one or more removable flexible connectors.

* * * * *